United States Patent [19]

Negola et al.

[11] 4,097,232

[45] Jun. 27, 1978

[54] METHOD AND APPARATUS FOR TREATMENT OF YARN IN PACKAGE FORM

[75] Inventors: Edward J. Negola, Atlanta; Jerald Brown, Jasper, both of Ga.

[73] Assignee: Glen Head, Inc., Jasper, Ga.

[21] Appl. No.: 636,701

[22] Filed: Dec. 4, 1975

Related U.S. Application Data

[63] Continuation-in-part of Ser. No. 628,374, Nov. 3, 1975, abandoned, which is a continuation-in-part of Ser. No. 541,127, Jan. 15, 1975, abandoned.

[51] Int. Cl.[2] ..... D06P 5/22; D06B 11/00

[52] U.S. Cl. ..... 8/65; 8/14; 8/63; 8/66; 8/154; 8/155.1; 8/155.2

[58] Field of Search ..... 8/14, 65, 66, 63, 154, 8/155.1, 155.2; 252/8.6

[56] References Cited

U.S. PATENT DOCUMENTS

| | | | |
|---|---|---|---|
| 1,607,928 | 11/1926 | Vanness | 8/14 |
| 3,120,422 | 2/1964 | Weir | 8/14 |
| 3,787,176 | 1/1974 | Vonder Eltz et al. | 8/14 |
| 3,878,575 | 4/1975 | Wedler | 8/155.1 |

*Primary Examiner*—John Kight, III

*Attorney, Agent, or Firm*—Jones, Thomas & Askew

[57] ABSTRACT

A method for treating yarn in package form with a yarn treating agent to modify the physical and/or chemical characteristics of the yarn comprising the steps of introducing the agent at selected portions of the outer surface of the package, and then infusing the agent into the package with a heated fluid applied under pressure. More particularly, the method of the present invention contemplates the treatment of yarn in package form with one or more dyes or dye acceptance modifiers to modify or dye the yarn fibers in a reproducible manner to provide repeating contiguous sections of yarn having the desired characteristics. In one preferred embodiment of the invention, a dye acceptance modifier in the form of a resist is infused into one or both of the ends of a yarn package and a heated fluid is then introduced under pressure at a temperature and for a time sufficient to cause the resist to partially penetrate the package and contact individual strands of yarn or fibers, and to set the resist, if necessary.

In another preferred embodiment of the invention, a plurality of dyestuffs are introduced at the ends of the package, and a heated fluid, such as steam, is then introduced for a time sufficient to cause the dyes to at least partially penetrate the package.

In addition, the present invention contemplates an apparatus in which the aforementioned method may be practiced to treat yarn in package form either with dyes, dye acceptance modifiers, or other treating agents, to achieve desired characteristics. In its preferred form, the apparatus comprises a foraminous member which permits treatment of the package at selected portions of the outer surface thereof.

19 Claims, 8 Drawing Figures

METHOD AND APPARATUS FOR TREATMENT OF YARN IN PACKAGE FORM

CROSS REFERENCES TO RELATED APPLICATIONS

This application is a continuation-in-part of application Ser. No. 628,374 filed Nov. 3, 1975 for METHOD AND APPARATUS FOR TREATMENT OF YARN IN PACKAGE FORM now abandoned, which is a continuation-in-part of application Ser. No. 541,127 filed Jan. 15, 1975, now abandoned.

BACKGROUND OF THE INVENTION

This invention relates generally to the treatment of yarn in package form, and more particularly to a new method for treating yarn in package form with a yarn treating agent to modify the physical and/or chemical characteristics of the yarn comprising the steps of introducing the agent into selected portions of the outer surface of the package, and then infusing the agent into the package with a heated fluid applied under pressure. In one aspect of the present invention, the method involves treating yarn in package form with one or more dyes to create a repeating sequence of colors in a reproducible manner.

In another embodiment of the method of the invention, a dye acceptance modifier, e.g. a resist, is infused into one or both of the ends of a yarn package and a heated fluid, e.g. steam, is then introduced under pressure at a temperature and for a time sufficient to cause the dye acceptance modifier to partially penetrate the package and contact individual strands of yarn or fibers, and to set the dye acceptance modifier, if necessary. The yarn so treated may then be dyed directly by conventional techniques, or fashioned with other ends of treated or untreated yarns to form a fabric after which the fabric is dyed to provide a pleasing pattern of several tones or shades.

In another embodiment of the invention, a plurality of dyestuffs are introduced at the ends of the package, and a heated fluid, such as steam, is then introduced for a time sufficient to cause the dyes to at least partially penetrate the package.

In addition, the present invention contemplates an apparatus in which the aforementioned method may be practiced to treat yarn in package form either with dye acceptance modifiers, dyes, or other treating agents, to achieve desired characteristics.

In general, the pleasing color effects which can be obtained in a fabric through the use of what is commonly referred to as "space dyeing" have been recognized in the art. Furthermore, methods and apparatus have been developed over the years to achieve such effects by selectively dyeing portions of a yarn package. As used herein, the term, "yarn in package form", is intended to denote and mean a mass of yarn which is wound on a tube, cone, pirn or other such conventional holders. These methods fall into two broad categories. One of these categories involves the use of needles to inject dye into selective portions of the yarn package. Typical of this type of treatment is the process disclosed in U.S. Pat. No. 3,547,575. Such prior art methods are time consuming and present problems with reproducibility and uniformity of dyeing. Furthermore, when using fine denier yarns, the needles usually tear the yarn fibers causing obvious problems when the yarn is subsequently fashioned into a fabric by weaving or knitting.

The second broad category of prior art processes is typified by U.S. Pat. No. 3,145,398 in which dye is forced radially through selective portions of a yarn package through the use of centrifugal force. The centrifugal force method exhibits the inherent disadvantage of distorting the yarn package during the process.

It is noted, in passing, that pressure per se has been used in the prior art for dyeing yarn in package form. However, in such prior art processes, as disclosed for example in U.S. Pat. Nos. 3,878,575 and 1,841,024, the entire package was uniformly dyed to the same shade or color.

Space dyeing has also been accomplished through the use of resists which alter dye sites in the yarn to cause them to be unreceptive to certain kinds of dyes. See, for example, U.S. Pat. No. 3,743,477 which discloses certain fiber-reactive compounds which may be applied to specified fibers to provide local reservation against dyeing with anionic or acid dyes. See also the application of resists by roller printing to form a pattern of resist and non-resist sections as disclosed in U.S. Pat. No. 3,700,402. However, roller printing fine denier yarns is both impractical and commercially unattractive because of the high cost.

In summary, each of the prior art methods of achieving a varigated dye effect on yarn has one or more undesirable characteristics which has heretofore limited the commercial acceptance of these methods. The need for a new technique which provides the desired pleasing multi-colored or ombre effect, without undesirable features, is evident.

SUMMARY OF THE INVENTION

The present invention is predicated, in part, on the discovery that a yarn treating agent can be selectively and reproducibly infused into a mass of yarn in package form by means of a fluid at elevated temperature under pressure. The heated fluid under pressure causes the yarn treating agent to penetrate both the package and the individual strands of yarn or fibers to a predetermined depth, and, if desired, to fully penetrate the package. This unique and unobvious solution to the long-standing problem in the yarn dyeing field provides a simple, practical and commercially attractive method of obtaining the objectives of space dyeing without any of the drawbacks of the prior art processes.

The method of the present invention involves introducing a yarn treating agent, e.g. a dye acceptance modifier or a dye into selected portions of the outer surface of a yarn package, followed by exposing such surface portions to a fluid at elevated temperature and pressure. The heated fluid passes through the yarn package and carries with it the yarn treating agent. In this manner, controlled penetration of the yarn treating agent is obtained. Taking, for example, the method in which a dye acceptance modifier is infused or introduced at only one end of the package, the result of these process steps provides a yarn package having three different sections which have relatively varying amounts of dye acceptance modifiers. In the section contiguous to the end at which the dye acceptance modifier was infused, there is a relatively large concentration of modifier. In the section contiguous to the opposite end of the yarn package there is little or virtually no dye acceptance modifier present. In the middle section there is a concentration or proportion of modifier which is intermediate that of the two end sections. It can be seen that as the yarn is unwound from the package so treated, there will be repeating sequences of contiguous lengths of yarn which are fully treated, intermediately treated, and untreated by the dye acceptance modifier. In the situation in which a conventional resist is used as the dye acceptance modifier, there is thus provided by the present invention a mass of yarn having repeating sequences of contiguous sections which, after dyeing, will result in high dye acceptance, moderate dye acceptance, and no dye acceptance.

In a preferred embodiment of the present invention, a yarn package may be treated with one or more dyes thereby producing yarn which has contiguous sections of differently colored lengths. For example, if a first dye is introduced at one end of the package, and a different color dye is introduced at the other end of the package, yarn having lengths of the two colors in addition to a blend of the two colors will be produced. Moreover, by a manner discussed in detail hereinbelow, it is possible to introduce two or more dyes at each end of the package thereby providing a dyed yarn which has contiguous lengths of at least four colors and additional lengths of blends of the colors or dyes used.

As used herein the term "end" of a package of yarn is intended to denote a face of the yarn package which is perpendicular to the longitudinal axis of the wound yarn. Using this terminology, a yarn package has two ends and a circumferential surface, the latter being cylindrical or conical in shape, for example, depending upon the method of winding employed. As used herein, the term "yarn in package form" is intended to denote and mean a mass of yarn which is wound on a tube, cone, pirn or other such conventional holders. As used herein, the terms "fiber" and "yarn" have the same meaning as those normally used in the art, i.e. "fiber" means an individual filament of natural or synthetic material and the term "yarn" means a bundle of several fibers gathered together and normally twisted together.

The inherent advantage of the present invention is that it makes possible the treatment of a large mass of yarn in compact form, i.e. in the form of a package of yarn rather than in skein, warp, or knitted sock form. The particular type of package employed in the present invention is not critical. Thus the yarn may be wound on a cone, tube, pirn or wound to form a package in any similar manner. Of course, the repeat pattern of the yarn will vary in accordance with the method used to wind the yarn. For example, if the yarn is wound with constant speed and constant traverse, i.e. drum wound, and the package is treated from the ends, the repeat sections of the yarn which are fully treated, partially treated and untreated will be of the same proportional lengths throughout the entire mass of yarn in the package. This gives the most desirable effect and distribution of dyestuffs.

By the embodiment of the method briefly outlined above using a dye acceptance modifier, a package of yarn is obtained in accordance with the present invention which has the latent characteristics of a space dyed yarn package. However from the commercial point of view, the method of the present invention is highly advantageous in that a stock supply of treated yarn packages may be maintained in the undyed condition, thus substantially reducing the inventory which must be carried. Carrying this one step further, a knitter or weaver is enabled to fashion fabric made from such treated yarn packages in inventory before dyeing, thus substantially reducing the inventory of woven or knitted fabric which must be maintained by a mill, for example. As soon as it is desired to produce fabric of a certain color, the fabric so prepared is then dyed by conventional methods to provide the pleasing or attractive multi-colored effects commonly associated with space dyed yarns.

Direct dyeing of the package using another embodiment of the method in which one or more dyes are infused into different surfaces also offers many advantages. Color effects not otherwise obtainable are accomplished in a simple manner with maximum utilization of dye and minimum expenditure of energy.

It has further been discovered that the method of the present invention is reproducible in the sense that if the same amount of yarn treating agent is used followed by a uniform, non-varying, treatment with a heated fluid under pressure, the repeat sequences are substantially the same. Where more than one dye is used in accordance with the present invention, then the repeat sequences of the colors in the yarn package are also reproducible.

An additional aspect of the present invention is the manner in which yarn packages treated as aforementioned can be fashioned, by knitting or weaving for example, into a fabric. As disclosed hereinbelow, one or more ends of yarn treated in accordance with the present invention may be woven or knitted together with one or more untreated ends of yarn. In this manner, entirely new and pleasing effects may be obtained. Such fabric may also be subsequently dyed in the piece to produce multi-colored or variegated effects. Where the yarn heating agent is a resist, it is possible to create a pleasing appearance by utilizing one type of dye which selectively colors only the untreated ends of yarn, and another type of dye which selectively colors the fully or partially resisted portions of the ends treated in accordance with the present invention. Obviously many other possibilities of this type are possible to create new and unusual color effects. Mixing natural and synthetics, different types of synthetics gives new and unusual results.

The method of the present invention can also be used with treating agents which introduce dye sites into the fibers of a yarn in a selective manner. Thus, for example, when treating polyester yarns in accordance with the present invention, treating agents which create dye sites in the polyester may be employed to provide the same type of repeat pattern in the mass of yarn forming the yarn package.

In addition to the foregoing, yarn in package form may be treated with other agents such as yarn lubricants in order to create certain desired effects. In essence, the method of the present invention is useful in permeating a yarn package with any conventional or known yarn treating agent in a predetermined manner.

Also disclosed as part of this invention is an apparatus which is particularly suitable for performing the method described herein. In a preferred embodiment, the apparatus comprises means for metering preselected quantities of a yarn treating agent, e.g. a dye or dye acceptance modifier, means for introducing or infusing such metered amount into selected portions of the end or ends of a yarn package, e.g. by means of a foraminous plate, and means for exposing the yarn package to a heated fluid at elevated pressures to infuse the textile treating agent into the interior of the yarn package. It will be recognized by those skilled in the art that the apparatus of the present invention is also suitable for treating yarn packages with a variety of textile treating agents such as lubricant, for example.

THE DRAWINGS

The features and advantages of the present invention will become apparent from consideration of the specification when taken in conjunction with the accompanying drawings in which.

Figure 1:
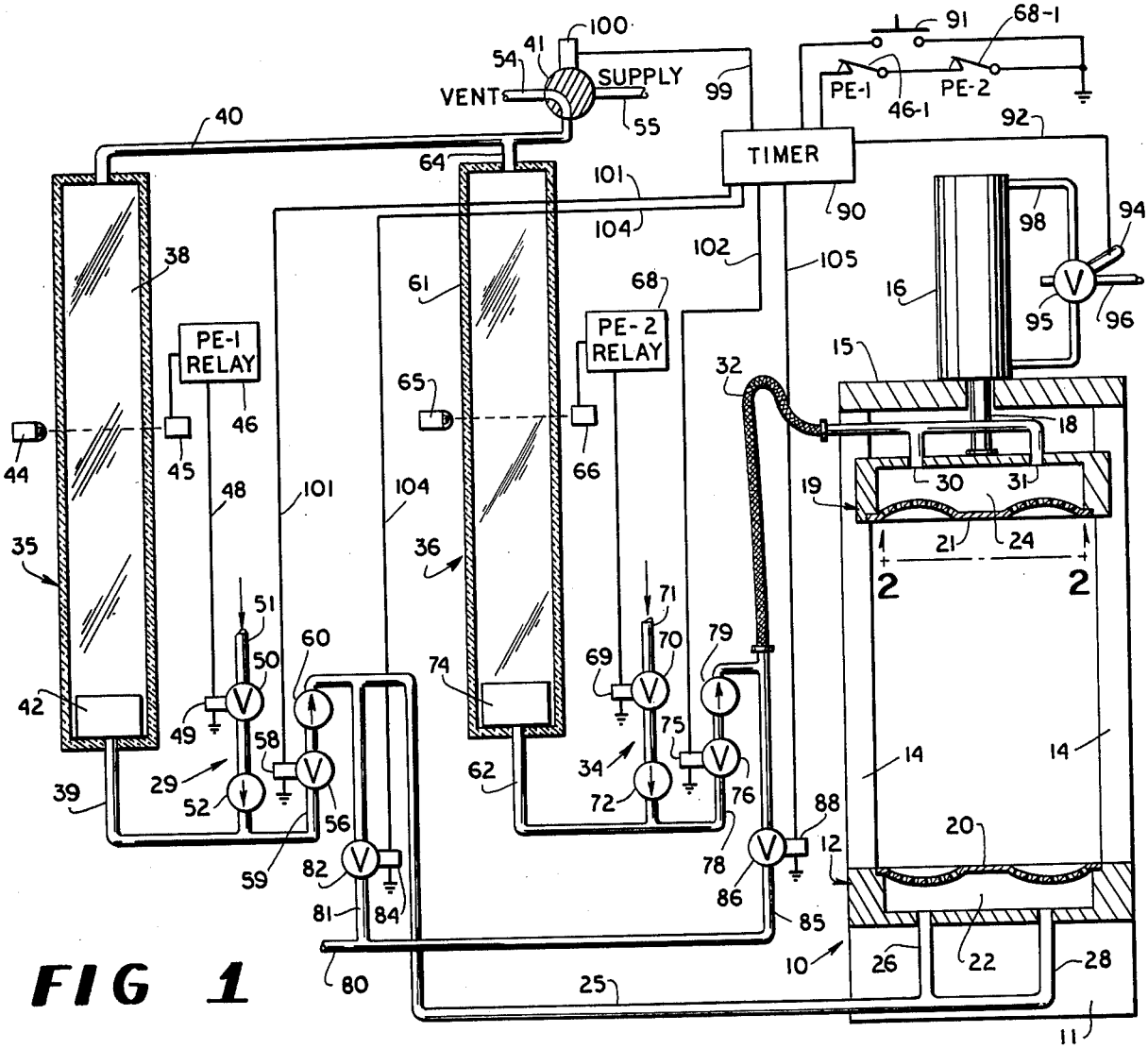
FIG. 1 is a schematic illustration of the apparatus made in accordance with the present invention for carrying out the method of the present invention.
Figure 5B:
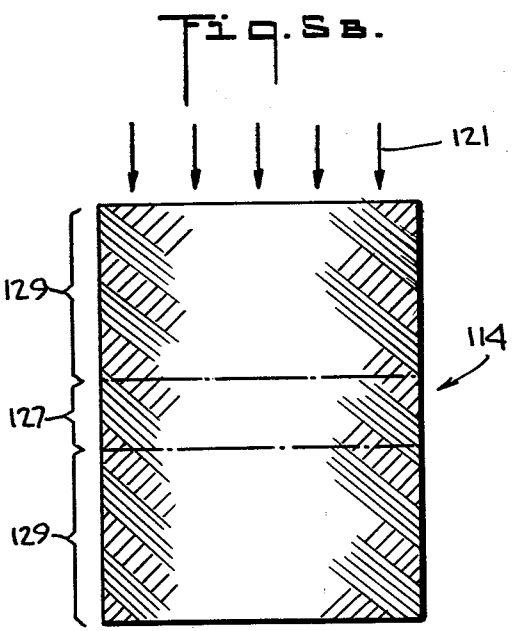
Figure 5A:
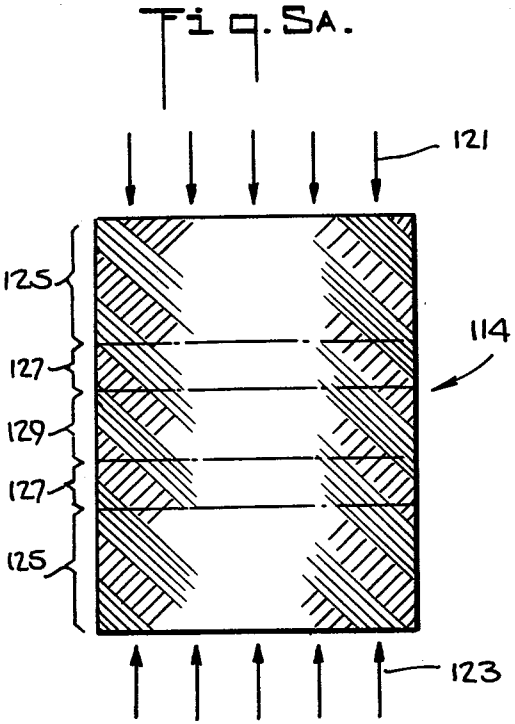
Figure 5C:
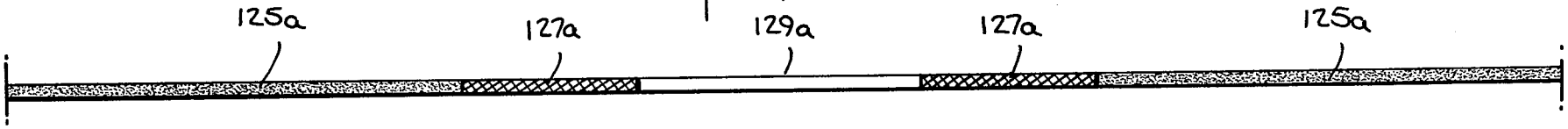
Figure 6:
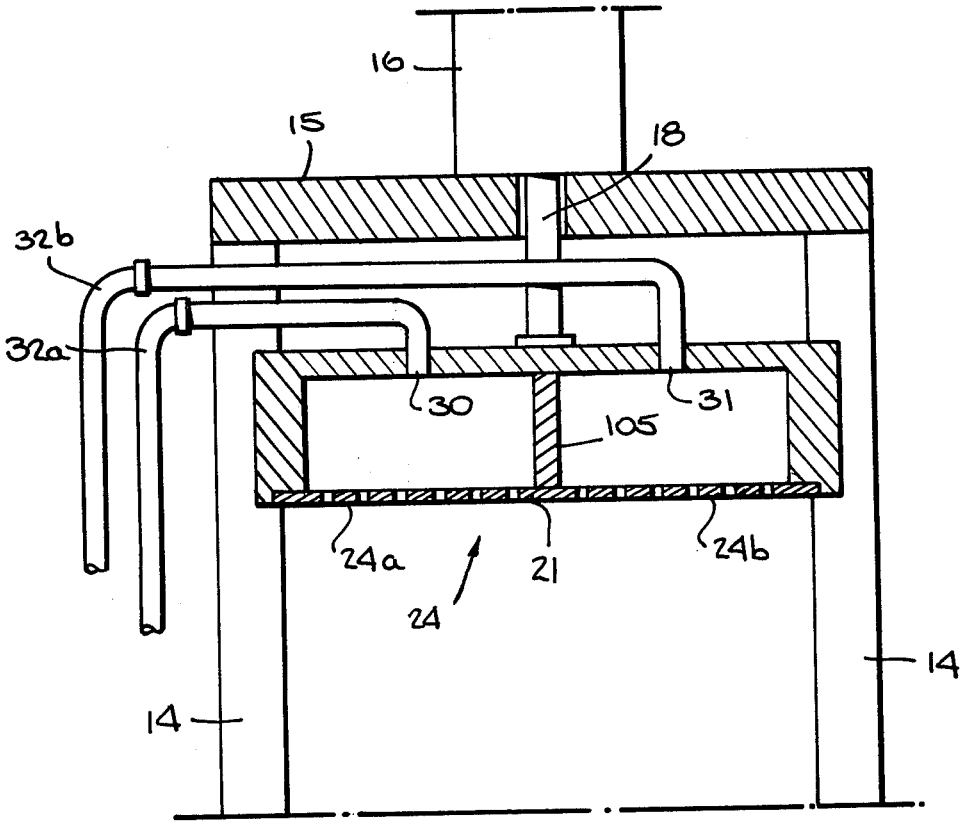

FIG. 5*a* is a schematic representation of a package of yarn being treated in accordance with one aspect of the present invention;

FIG. 5*b* is a schematic representation of a package of yarn being treated in accordance with another aspect of the present invention;

FIG. 5*c* is a partial schematic representation showing a length of yarn after treatment in accordance with the present invention; and FIG. 6 is a partial schematic illustration showing an alternative form of one of the headers depicted in FIG. 1.

DETAILED DESCRIPTION

To aid in a better understanding of the method of the present invention, attention is directed to FIGS. 5*a*, 5*b* and 5*c*. FIG. 5*a* schematically illustrates a yarn package 114 being treated in accordance with one aspect of the method of the present invention. A quantity of dye acceptance modifier is infused at both ends of package 114. This is schematically illustrated by arrows 121 at the top end and arrows 123 at the bottom end of package 114. The modifier may be applied in paste or viscous liquid form or, alternatively, may be introduced in liquid form under pressure using the apparatus disclosed herein.

Figure 2:
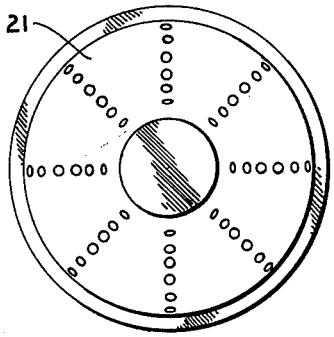
FIG. 2 is a plan view of package engaging plate substantially as viewed along line 2—2 in FIG. 1.

After the dye acceptance modifier is infused into the ends of the yarn package, a heated fluid under pressure, such as steam, is introduced at the ends of package 114. Thus arrows 121 and 123 also schematically indicate the flow pattern of the heated fluid or steam. Of course, some means such as a perforated plate depicted in FIG. 2 hereof, is desirably used in order to appropriately confine the heated fluid under pressure. The action of the heated fluid moving through package 114 carries with it dye acceptance modifier.

Following treatment in accordance with the present invention, cylindrical section 125, shown in FIG. 5*a* as being contiguous with the ends of package 114, will be found to have been substantially completely treated with the dye acceptance modifier. Section 129 in the approximate middle of package 114 will be found to be substantially untreated by the dye acceptance modifier, and intermediate sections 127 will be found to have been partially treated with the dye acceptance modifier.

FIG. 5*c* schematically illustrates the latent characteristics of a portion of the yarn of package 114 treated as described above. Thus there will be lengths of yarn 125*a* which are fully treated with the dye acceptance modifier, lengths 127*a* which are partially treated, and lengths 129*a* which are substantially untreated. Each of these lengths, 125*a*, 127*a* and 129*a*, will have a different dye receptivity as a result of the differential treatment in accordance with the process of this invention.

If package 114 is wound with constant speed and constant traverse, i.e. drum wound, then throughout package 114, the repeating sequences of lengths 125*a*, 127*a* and 129*a* will be substantially equal, varying only slightly from beginning to end. The relative or proportional variation between lengths 125*a*, 127*a* and 129*a* is a function of the amount of dye acceptance modifier used, and the length of time and the pressure and temperature of the heated fluid which is utilized. Selection of these parameters is well within the skill of one familiar with this art in view of the examples set forth below.

FIG. 5*b* schematically illustrates a yarn package 114 being treated by infusing dye acceptance modifier at only the top end of the package, as shown by arrows 121. In such embodiment there are only three distinct sections of yarn package which have different treatments; section 125 which will be substantially fully treated, section 129 which will be substantially untreated, and intermediate section 127 which will be partially treated.

In a typical illustrative embodiment employing the method of the present invention, nylon 66 is treated using as a dye acceptance modifier, one of the conventional resist chemicals such as Verona Resist made by the Verona Chemical Company or Sandox Space R manufactured by the Sandoz Chemical Company. In the event that the resist selected for use in this process is required to be set, the heated fluid, e.g. steam, accomplishes this objective.

The simplicity of the method of the present invention permits more than one yarn treatment to be accomplished during a single processing. Thus, for example, in addition to the introduction of dyes or a dye acceptance modifier, the yarn may be treated with a lubricant and thereby avoid a separate, subsequent operation. As is well known, lubrication of yarn is a virtual necessity prior to knitting and usually involves rewinding of the package.

In accordance with the present invention the yarn so processed may then be constructed by weaving, knitting or the like to form a fabric which may then be dyed or overdyed. In making the fabric, as will be more fully seen in the examples below, one or more treated and untreated ends may be used to form the fabric and thereby provide a wide range of color combinations in the finished fabric. Furthermore, different dye combinations may be used to obtain different color patterns. With reference to FIG. 5*c*, it will be noted that if the dye acceptance modifier is a conventional resist which resists acid dyes, and the yarn is then dyed with an acid dye, sections 125*a* will be undyed, sections 127*a* will be moderately colored, and sections 129*a* will exhibit a deep shade of color.

Apparatus according to the present invention for performing the methods described herein will now be described.

Referring now more particularly to the embodiment of the apparatus of the invention here chosen by way of illustration, it will be seen in FIG. 1 that there is a package receiving chamber 10 having a base 11 that supports a bottom header 12. Stanchions 14 support a top plate 15, and the top plate 15 has a pneumatic cylinder 16 thereon with the piston rod 18 extending through the top plate 15. At the lower end of the piston rod 18 there is a top header 19. It will therefore be understood that the arrangement is such that, as the piston rod 18 is projected from, or retracted into, the pneumatic cylinder 16, the top header 19 will move up or down.

Each of the headers 12 and 19 carries foraminous plates 20 and 21 respectively. The plates 20 and 21 cover cavities 22 and 24 respectively in the headers 12 and 19, and the plates 20 and 21 are preferably interchangeable to allow other shapes and designs of foraminous plates to be used.

In the embodiment shown in the drawings hereof, foraminous plates 20 and 21 are the conduits through which the treating agent is introduced to the yarn package. In addition, the outer surface of the plates forms a pressure tight seal with the periphery of the ends of the package being treated so that the yarn treating agent or steam does not escape into the atmosphere but rather passes into the package. It should be understood that the circumferential portion of plates 20 and 21 can be extended to form a sleeve which would totally enclose the yarn package during the operation of the apparatus. An additional variant is that a plate having a plurality of open spaces, rather than holes could also be used provided the plate is sufficiently wide so that it forms a proper seal with the ends of the yarn package.

Tube 25 is connected at one of its ends through branch input tubes 26 and 28 to the lower header 12 and is in communication with the cavity 22. Tube 25 is connected at its other end to the bottom header control means which is generally designated at 29 and will be discussed in greater detail in a later portion of this specification.

Flexible tube 32 is connected at one of its ends through branch input tubes 30 and 31 to top header 19 and is in communication with cavity 24. Flexible tube 32 is connected at its other end to the top header control means 34 which will be discussed in greater detail in a later portion of this specification.

From the foregoing discussion, it should now be understood by those skilled in the art that a textile yarn package of any conventional form may be placed on the lower foraminous plate 20. The pneumatic cylinder 16 may be operated so that the piston rod 18 is projected to lower the top header 19 until the upper foraminous plate 21 engages the top surface of the yarn package. The foramina in the foraminous plates 20 and 21 are located so they will engage the yarn that is on the yarn package and will not engage the tube or other core material on which the yarn is wound. Means are provided for introducing a desired yarn treating agent, such as a dye or dye acceptance modifier, through the tubes 25 and 32 so that the chemical passes into the cavities 22 and 24, through the foramina in the foraminous plates 20 and 21 and into contact with the yarn of the yarn package.

In accordance with one embodiment of the method of the present invention, a predetermined amount of yarn treating agent is infused into at least one surface of the yarn package. The apparatus illustrated in FIG. 1 is one in which infusion into both ends of the yarn package can take place.

The apparatus capable of performing this aspect of the present invention therefore includes a first measuring means 35 for measuring treating agent that is to be infused into the bottom surface of the yarn package, and a second measuring means 36 to measure treating agent that is to be infused into the top surface of the yarn package. In more detail, the first measuring means 35 includes a container 38 having a tube 39 in communication with the container 38 and extending from the bottom of the container 38, the tube 39 being connected to the control means 29. At the top of the container 38, there is a tube 40 that is connected to a valve 41. Within the container 38, there is a float 42; the float 42 is adapted to float on the surface of material which is introduced into the container 38 through the tubing 39.

As here contemplated, the walls of the container 38 are transparent, and there is a light source 44 on one side of the container 38 and a photoelectric cell 45 on the opposite side of the container 38 and located to receive light from the light source 44. A relay 46 is connected to the photoelectric cell 45 to be energized or deenergized in accordance with whether or not the photoelectric cell 45 receives light from the light source 44. Thus, it will be seen that when the float 44 floats on the top of the material that is introduced into the container 38, and the float 42 rises to a point that is between the light source 44 and the photoelectric cell 45, the light from the light source 44 to the photoelectric cell 45 will be interrupted so that the relay 46 will be deenergized.

The relay 46 is connected, through wire 48, to a solenoid 49, the solenoid 49 being arranged to operate a valve 50. Tubing 51 leads from the valve 50 to a holding tank, or other source of modifier ready material or agent or combination thereof, under pressure so that, when the valve 50 is open, material will flow through the tube 51, through the valve 50, thence through a check valve 52 and to the tubing 39 which will allow the material to pass into the container 38. As the material fills the container 38, the float 42 will float on top of the material until the float 42 reaches the level of the photoelectric cell 45 and its light source 44. When the float 42 blocks the light source 44, the relay 46 will be deenergized and this will in turn deenergize the solenoid 49 and cause the valve 50 to close. When the valve 50 closes, it will readily be seen that the flow of material from the holding tank to the container 38 will be terminated.

As the material rises in the container 38, the air in the container 38 must be displaced; therefore, the valve 41 is positioned as shown thereby allowing air to escape from the container 38 through the tubing 40 and through the valve 41 to the vent pipe 54.

After the desired quantity of material has been introduced into the container 38, the valve 41 is shifted so that a source of compressed air or other suitable inert gas which is available at the tubing 55 is connected through the valve 41 to the tubing 40 so that compressed air is placed onto the container 38 above the material. Also at this point, a valve 56 is opened by energizing a solenoid 58 so that material can flow out of the container 38 under the pressure of the compressed air, through the tube 39, thence through the branch 59, through the valve 56, through a check valve 60 and into the tube 25 from which the material will pass through the input tubes 26 and 28 and into the cavity 22 of the lower header 12 and then into the yarn package.

The second measuring means 36 is similar to first measuring means 35 so that the measuring means 36 will not be discussed in detail. It will be noted that the measuring means 36 includes a container 61 having a lower tubing 62 and an upper tubing 64 that is connected to the tubing 40. A light source 65 is provided for a photoelectric cell 66, the photoelectric 66 operating a relay 68. The relay 68 controls a solenoid 69 to operate a valve 70. The valve 70 connects the source of material through a tubing 71, through a check valve 72, then through the tubing 62 and into the container 61 to cause a float 74 to rise to block the light beam from the light source 65.

When material is expelled from the container 61 through the tubing 62, a solenoid 75 is energized to open a valve 76 to allow the material to pass through the branch 78, through the valve 76 and through a check valve 79, into the tubing 32, then into tubing 30 and 31 and then into cavity 24 and into contact with the yarn package.

After the material has been dispensed to the ends of the yarn package, a heated fluid under pressure is similarly dispensed into contact with the ends of the package to disperse and diffuse the dye acceptance modifier, dye or treating agent into the interior of the package, and to set the agent if necessary.

In the examples set forth below, the heated fluid employed in the method of the present invention is steam. For simplicity of exposition, the following discussion will be in terms of the use of steam as the heated fluid but it should be understood that other fluids may be used provided the particular yarn treating agent does not require the presence of moisture or water vapor. When the steam or heated fluid passes through the valve 82, it will continue through the branch 81 to the tube 25 to be injected into the bottom end of the yarn package through bottom header 12. Similarly, the steam will pass from the tube 80 into the branch 85 where it will pass through a valve 86 that is operated by a solenoid 88. When the steam passes through the valve 86 it will continue through the branch 85 to the flexible tube 32 to be injected into the top of the yarn package through top header 19.

When the steam enters the yarn package, it initially condenses and forms moisture. As more steam enters the package, the amount of water within the package may change. Depending on the steam pressure and temperature, and duration of treatment, a drying step may be useful in order to remove any excess moisture.

Turning now to the control system for the above described apparatus, it will be seen that there is a timer 90 that is electrically operated and is started by means of a pushbutton 91. When the button 91 is depressed to close the circuit the timer 90 is started and a circuit is immediately closed to place a voltage on the wire 92 to energize the solenoid 94 and shift a valve 95 to allow compressed air to flow from the supply line 96, through the valve 95 and to the tubing 98 which places compressed air in the rear of the pneumatic cylinder 16 to cause the piston rod 18 to be projected. It will be remembered that, when the piston rod is projected, the upper header 19 will be lowered to engage the yarn package in preparation for the dispensing of the material into a yarn package; however, if the containers 38 and 61 are not filled with material to the predetermined level the process should not proceed because the quantity of material would not be the amount desired.

While numerous interlock means may be provided to assure that the material is not dispensed until the predetermined amount has been measured out, there is here shown a simple holding circuit wherein the timer 90 continues to run only if the switches 46-1 and 68-1 are closed. It should be understood that the switch 46-1 is a relay contact that is operated by the relay 46, and the switch 68-1 is a relay contact that is operated by the relay 68. It will therefore be seen that when the relay 46 is energized it is an indication that light from the light source 44 is contacting the photoelectric cell 45 to energize the relay 46 and the solenoid 49 is energized to open the valve 50 and allow material to flow into the container 38. Since the relay 46 is energized under these conditions the switch 46-1 will be open; however, when the material rises in the container 38 sufficiently to allow the float 42 to block the beam of light from the light source 44, the relay 46 will be deenergized to allow the switch 46-1 to return to its normal, closed, position. The same holds true of the switch 68-1; and, since the switches 46-1 and 68-1 are connected in series, both switches must be closed in order to act as a holding circuit for the timer 90 and continue operation.

Assuming that when the upper header 19 is fully lowered against the yarn package, the containers 38 and 61 are filled to their predetermined levels, the timer 90 will place a voltage on the wire 99 to energize the solenoid 100 and shift the valve 41 to connect the compressed air supply through the pipe 55, through the valve 41 and to the tubing 40. Also, the timer 90 will place a voltage on the wire 101 and on the wire 102 to energize the solenoids 58 and 75 respectively thereby opening valves 56 and 76 respectively so that material will flow from the containers 38 and 61, through the tubes 39 and 62, through the valves 56 and 76 and to the tubes 25 and 32.

After a predetermined length of time, the timer will remove the voltage from the wires 99, 101 and 102 so that: valve 41 will shift to vent the containers 38 and 61 through the tube 40 and through the vent tubing 54; the solenoid 58 will be deenergized to close the valve 56; and the solenoid 75 will be deenergized to close the valve 76. At this time, the timer 90 will place a voltage on the wires 104 and 105 to energize the solenoids 84 and 88 respectively to open valves 82 and 86 respectively, thereby allowing steam to pass from the pipe 80 and into the branches 81 and 85, pass through the valves 82 and 86 thence into the tubes 25 and 32.

It will be noticed that, once the valves 56 and 76 are closed, the valve 41 is shifted to vent the containers 38 and 61 and the material has been removed from the containers so that the floats 42 and 74 are at the bottom of the containers to allow the light sources 44 and 65 to direct their light to the photoelectric cells 45 and 66 so that the relays 46 and 68 are energized and will energize the solenoids 49 and 69 to open the valves 51 and 70 so that material will again be introduced into the containers 38 and 61. By the end of the cycle of treatment of a single package of yarn, the containers 38 and 61 will again be filled to the predetermined level with a fresh batch of material so that the next package of yarn can be treated without delay.

Figure 3:
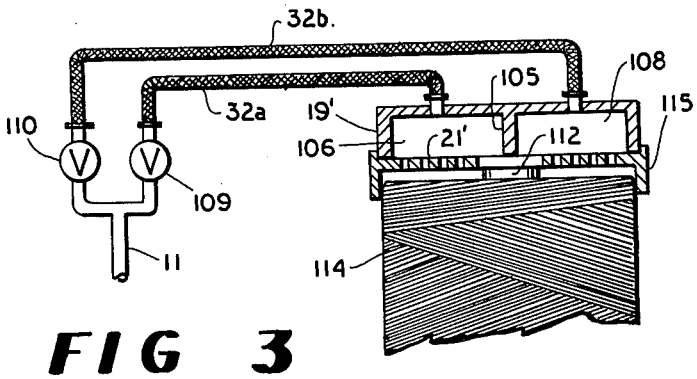
FIG. 3 is a partial schematic view showing an alternative control arrangement for the header member shown in FIG. 1.

For a variation in the pattern of treatment of a package of yarn, attention is directed to FIG. 3 of the drawings which shows a modified form of upper header designated as 19'. The header 19' includes a dividing wall 105 so that the cavity is divided into two separate and distinct cavities 106 and 108. From the cavity 106, there is a flexible tubing **32*a*, and from the cavity 108 there is a flexible tubing 32*b*. In each of the tubings 32*a* and 32*b*, there is a valve designated at 109 and 110. With this arrangement it will be seen that material may be passed through the common tubing 111, through the two valves 109 and 110, through the tubes 32*a* and 32*b* and into the cavities 106 and 108. Since each of the tubes 32*a* and 32*b* can be separately controlled by means of its own valve 109 or 110, it will be seen that the material flowing into each of the cavities 106 and 108** can be separately controlled to vary the amount of material that is dispensed to individual portions of the yarn package. Also, steam is passed through the same lines so that the quantity of steam that is dispensed to separable portions of the yarn package can be varied.

In another embodiment shown in FIG. 6, tubes 32*a* and 32*b* are connected to separate sources of treating agents, not shown, so that two different yarn treating agents, e.g. two different dyes, can be introduced into the upper end of the yarn package 114.

FIG. 3 also depicts another modification of the apparatus shown in FIG. 1. In FIG. 3, foraminous plate 21' is not in contact with the upper surface or end of yarn package 114. With this arrangement, a treating agent such as a yarn lubricant with be nonselectively sprayed against the upper end of yarn package 114. To prevent splatter of chemical as it is dispensed onto the yarn package 114, skirt 115 carried by the upper header 19' and extending down to cover the upper portion of the yarn package 114 is provided.

Figure 4:
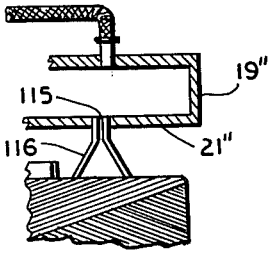
FIG. 4 is a partial schematic representation showing a modified form of the package engaging plate.

A further modification for selectively treating portions of a yarn package is shown in FIG. 4 of the drawings. Here it will be seen that the header 19" includes a foraminous plate 21", one foramen 115 expanding into a substantially cone-shaped member 116. While the shape of the member 116 may vary as desired, the object is to provide an enclosure in communication with a foramen whereby material will pass through the foramen 115, and into the enclosure 116 to treat a discreet portion, or spot, on the yarn package.

With the description of the foregoing embodiments of the apparatus and some discussion of its operation in mind, the treating of the packages of yarn therewith should now be understandable by those skilled in the art. Set forth below are several Examples of treatment with a dye acceptance modifier and lubricant, which are intended to be illustrative of one embodiment of the present invention. The dye and resist chemistry involved are well within the skill of the art. It of course, should be appreciated that the Examples are intended as exemplary, and that variations and substitutions may be made.

EXAMPLE 1

A 2½ pound package of drum wound 100/26/1 nylon 66 yarn is used. (The designation "100/26/1" means that the yarn is 100 denier, 26 filaments, and the yarn is not plied.) The apparatus described above has such a package placed therein and the steam portion of the apparatus used to shoot steam through a number of packages of this nature to warm up the apparatus. The steam is maintained at a temperature approximately 300° F and at a boiler pressure between 90 and 100 psi. After warming up the apparatus, a 2½ pound package to be treated is inserted in the treatment chamber. Sandoz Space R resist available from Sandoz Chemical Company in an amount by weight of from 2 to 3½% of the weight of the package is mixed with water in a volume ratio of approximately 7½ to 1. To this mixture trisodium phosphate is added to adjust the pH of the mixture to between 8 and 10. This mixture is stored in a holding tank which is the source of the material to be introduced through the valves 60 and 70. The holding tank maintains the resist at ambient temperature. The resist is kept in solution by whipping or stirring. The mixture so obtained is pumped from the holding tank and then infused into the yarn package followed by steam at approximately 300° F and between 90 and 100 psi. The steam is maintained for approximately 1½ minutes.

It will be understood by those skilled in the art that resist chemicals used in the treatment of nylon may have a relatively high viscosity which is lowered by heating. Such resists are also cured or set in the yarn by the use of elevated temperatures.

In the process of Example 1, when the resist chemical is dispensed onto the package of yarn for infusion, there may be some penetration of the material into the package because of the pressure of the compressed air acting on the chemical and the fact that the chemical is in liquid form; however, there will not be a significant penetration of the chemical either into the package of the yarn or the individual fibers of yarn. The steam immediately following infusion lowers the viscosity of the resist causing it to penetrate both the package of yarn and the individual fibers of the yarn. Furthermore, the steam causes the resist chemical to cure or set in the yarn.

A dye bath is prepared, in which an acid yellow dye, Sevron blue ACN dye and a Sevron red YCN dye are separately added to the bath along with a retardant such as Sandoz CCm is conventional fashion. The acid yellow dye will dye only those portions of the nylon which are untreated or partially treated; the Sevron blue ACN and Sevron red YCN are cationic and will dye the yarn only in the areas which have been resisted partially or completely. The bath is brought to a boil after which yarn having repeating length, such as shown in FIG. 5*c* is dyed and treated in conventional fashion. The result is yarn having sections 125*a* colored blue, sections 127*a* colored light blue and sections 129*a* colored yellow.

EXAMPLE 2

The apparatus of the present invention is warmed up in the manner described in connection with Example 1 and a 2½ pound package of 100/26/1 denier nylon 66 yarn placed in the treatment chamber. Sandoz Space R resist in an amount by weight of from 2 to 3½% of the weight of the package is mixed with a lubricant such as common coning oil in an amount which is about 2% of the weight of the package. To this mixture is added water to obtain a volume ratio of water and lubricant to the volume ratio of resist which is about 8½ to 1. The treatment chamber is enclosed by a cylindrical baffle which will allow steam to be slowly released from the yarn package but maintain steam in contact with its sides. Steam at approximately 300° F and boiler pressure between 90 and 100 psi is then applied as above for a period of 1½ minutes.

In this example, the trisodium phosphate is omitted since trisodium phosphate may react with certain resists to form by-products including hydrochloric acid or sodium chloride which can result in corrosion of knitting or weaving machines in which the yarn is subsequently used. Thus, the elimination of the trisodium phosphate avoids the possibility of corrosion. However, the trisodium phosphate does aid in setting so that in its absence it is necessary to remove yarn into an enclosed steam chamber so that steam is present outside the package to ensure proper setting of the resist. The use of a steam chamber is indicated when the rate of setting of the resist is slower than the rate of diffusion of the resist through the yarn package. If the package is maintained in this Example, in the apparatus, the resist will tend to diffuse out toward the sides of the package thus creating a different type of resist pattern than that which is desired. By treating the package in a steam chamber, the resist is caused to set without diffusion. Maintaining the package in a steam chamber for approximately 30 minutes at a relatively low temperature and pressure is satisfactory to achieve the desired result.

The addition of the lubricant is beneficial in that it avoids an additional processing step. If the yarn is not lubricated when being resisted, an additional step of winding the yarn off the drum, lubricating and then rewinding on a cone must be carried out. By simultaneously lubricating and resisting, these steps are eliminated and the drum wound package can be used directly in a knitting or weaving machine. In this process, although the resist only partially penetrates the package as shown in FIGS. 5*a* and 5*b*, the lubricant travels throughout the entire package evenly lubricating all fibers therein.

The yarn so prepared can then be dyed as in Example 1.

EXAMPLE 3

Packages of yarn are treated with resist as in Example 1 or Example 2. After that treatment, before dyeing, two ends of treated yarn are formed into a fabric by weaving. The result is a three tone fabric.

EXAMPLE 4

Packages of yarn are treated in the same manner as described in Examples 1 or 2. However, after treatment an end of 100/26/1 66 treated yarn is knitted with an end of 100/26/1 denier nylon 6 untreated yarn and the resulting fabric then dyed in the manner described in Example 1. The result is a fabric in which the untreated yarn is fully dyed a very deep yellow and the treated yarn consists of lengths of 3 shades of blue.

EXAMPLE 5

A 2½ pound package of nylon 66 yarn is treated using Verona resist chemical with the mixture made of up to 10 to 10½% by weight of resist mixed with water in a volume ratio of approximately 7½ to 1. Formic acid is then added to the mixture to adjust the pH to be between 2½ and 3½. The yarn is then treated in the manner described in Example 1.

EXAMPLE 6

A yarn package known in the industry as a cheese and comprising a flat package of yarn of narrow thickness is placed in the apparatus of the present invention. Resist is prepared in accordance with Examples 1 or 2. This mixture is infused into the cheese in the manner described in Example 1 followed by steam. With a flat package of this nature and the amount of resist indicated, the entire package will be resisted to the extent that no dye will be taken up for the yarn and the yarn will remain colorless during any subsequent processing.

The yarn may then be subsequently processed by weaving, knitting, etc. with an untreated end whereupon the resulting material may be dyed with only the untreated portions of the yarn taking up acid dye. Both the treated and untreated ends may also be dyed with disperse dye and the treated end may also be dyed with a cationic dye.

EXAMPLE 7

A 2½ pound package of drum wound 100/26/1 denier nylon 66 yarn is placed in the treatment chamber of the present invention. A lubricant such as coning oil in an amount based on mineral oil having a weight which is 2 to 2½% of the weight of the package is mixed with water in a volume ratio of approximately 7½ to 1. This mixture is then infused into the yarn package in the manner described above in Examples 1 and 2 in connection with the resist or resist lubricant. The infusion is followed by steam at 90 to 100 psi at a temperature of approximately 250° F. The lubricant diffuses completely throughout the yarn package completely and evenly lubricating it so that a separate lubricating step during which the yarn is wound on and off a drum or cone is no longer necessary and the yarn can then be immediately processed in a knitting or weaving machine or the like.

Of course, the relative proportion of treating agent to the weight of package may be varied to produce differing results. Thus, for example in a situation in which a resist is used, if the amount thereof is increased, the proportion of yarn in the package which is resisted, increases. It is believed that the repeating sequences of fully treated, partially treated, and untreated sections is dependent upon the relative rate of the setting of the resist as compared with the rate of diffusion of the resist through the package. Stated another way, if the rate of set of the resist is substantially higher than the rate of diffusion of the resist through the package, the fully resisted and partially resisted lengths of yarn would be relatively shorter as compared to the untreated sections. In contrast when the rate of diffusion of the resist through the package is substantially higher than the rate of set, the untreated lengths of yarn would be relatively shorter.

When using a resist as the treating agent and steam as the heated fluid in accordance with the method of this invention, the temperature of the steam used is not critical unless it exceeds the temperature to which the resist may be safely exposed. Of course, the maximum temperature of the steam will also be dependent upon the melting or softening point of the yarn utilized. Normally steam at a temperature in the range of from about 225° to 350° F may be used.

The steam employed may contain small amounts of moisture for example about 7%. From a practical standpoint, it is preferred that the steam be relatively dry to avoid the necessity of drying the yarn package after treatment in accordance with the method of the present invention.

Generally, the time of subjecting the package to the steam should be for at least about 30 seconds in order to obtain desirable results. Preferably the steam can be directed against the yarn package for about one minute or longer up to approximately five minutes. Although five minutes is not a critical upper limit, there does not appear to be any noticeable improvement or change by the use of times in excess of five minutes.

The winding pattern or yarn to form a package takes many different forms in practice. Thus the yarn may be wound on a cone or tube and may be wound either with constant speed and constant traverse or with variations in either of these parameters. The effects which are obtained will of course vary depending upon the type of winding employed.

When employing resist in accordance with the method of the present invention the yarns so treated will be resistant to certain types of dyes. Thus the yarn, if dyed with such a dye, will have an area of full color, an area of intermediate color and an area of no color, corresponding to the lengths which are unresisted, partially resisted and totally resisted. Such yarns may be treated with a combination of dyes one of which follows the pattern above, and the other of which is uneffected by the resist, thus producing a very unique and different appearance. This same type of dye susceptibility and mixing of dyes may be employed to dye a fabric fashioned from one or more ends of treated yarn, and one or more ends of untreated yarn to give very pleasing, variegated effects.

Another use of the apparatus of FIG. 1 is for treating yarn packages with one or two dyes. In one aspect of such method, two different colored dyes are supplied to measuring means 35 and 36 and the process described above is then carried out. Through a proper selection of the amount of dye, it is possible, for example, to obtain penetration of the upper half of the package with one color, and penetration of the lower half with a second color. Of course, with additional dye, some mixing will occur in the middle region of the package and thus it will exhibit a color which is a blend of the first and second colors. Alternatively, by using lesser amounts of the dyes, an undyed portion in the middle region is obtained.

Another embodiment of the apparatus which is primarily useful for direct dyeing in accordance with the present invention is depicted in FIG. 6. As shown therein, a header assembly generally of the type shown in FIG. 1 is depicted. However, as can be seen, a dividing wall 105, e.g. a gasket, is introduced into header 19 in a manner which divides both the area of foraminous plate 21, and the cavity 24 within the header 19. In the embodiment shown, wall 105 is co-extensive with a diameter of plate 21 thus dividing cavity 24 into semi-cavities **24*a* and 24*b***.

Further as shown in FIG. 6, tube **32*a* is connected to semi-cavity 24*a* and tube 32*b* is connected to semi-cavity 24*b*. Tubes 32*a* and 32*b* are connected to two measuring means such as means 36 not shown. It is also to be understood that another header, similar to the one in FIG. 6 is also employed with tubes 25*a* and 25*b*, not shown, being connected to two additional measuring means, not shown. Thus, two different dyes, e.g. red and yellow, can be metered into semi-cavity 24*a* through tube 32*a*, and into semi-cavity 24*b* through tube 32*b*, respectively, in the manner described above in connection with FIG. 1. Likewise, an additional two dyes may be introduced into the opposing header, not shown, thus permitting the introduction of four dyestuffs into one package. Moreover, the cavity 24** can be divided into more than two separate sub-cavities, thus making it possible to use more than four different dyes to treat a single yarn package.

Examples of direct dyeing in accordance with the present invention are set forth below.

EXAMPLE 8

A package of polyester yarn was dyed with a plurality of dyestuffs using the apparatus of FIG. 1 as modified in accordance with the device shown in FIG. 6. The yarn which was dyed was in the form of a two and one-quarter pound drum-wound package of 18/1 C.C. polyester yarn. The upper and lower headers, and the respective foraminous plates in the apparatus were each divided into two sections by a gasket-type material so as to permit the separate introduction of four different dyeing solutions. Set forth below in tabular form are the solutions which were placed into the four respective measuring containers connected to the four sections of the headers.

Upper Header (1) First Dyeing Solution
13.3 milliliters Foron Yellow SEGLG
3.3 milliliters Foron Navy 2GL
33.4 milliliters water
(2) Second Dyeing Solution
8.3 milliliters Foron Red OWE
8.3 milliliters Foron Yellow SRL
33.4 milliliters water

Lower Header (1) First Dyeing Solution
16.6 milliliters Foron Blue SBGL
33.4 milliliters water
(2) Second Dyeing Solution
11.6 milliliters Foron Red Owe
5.0 milliliters Foron Yellow SEGLG
33.4 milliliters water The dyestuffs are high energy Foron sold by the Sandoz Color & Chemical Manufacturing Co. and in each instance the dyestuff used was a 5% solution dispersed in water.

Using pressure of approximately 60 psi, the upper and lower foraminous plates were brought into contact with the top and bottom ends of the yarn package. The dye solutions were then infused into the package for approximately 30 seconds using a pressure of approximately 15 psi. Then steam at a temperature of approximately 325° F and a pressure of 90 psi was introduced into the package for approximately two minutes.

The resulting package of yarn was multi-colored, one of the halves of the upper portion being dyed a pale green, and the other half of the upper portion was dyed a peach color. One of the halves of the lower portion was dyed a medium blue color, and the other half of the lower portion of the package was dyed a pale pink. There was a minimum of dye overlap and there were no undyed areas of yarn in the package. The dyed yarn thus consisted of contiguous repeating lengths of the four colors.

If it is desired to have a portion of the yarn remain in the undyed condition, the amounts of dyeing solutions are proportionally reduced. Conversely, if it is desired to have an overlap between the dyed sections of the yarn package, and thus obtain a blend of the dyestuffs at certain portions of the package, the amount of dyeing solution should be correspondingly increased. Clearly, it is within the skill of the art to increase or decrease the proportional amounts of dyeing solutions to achieve desired variations in dyeing, shades of color, and undyed areas.

EXAMPLE 9

The polyester yarn dyed in the manner described above in Example 8 together with undyed ends of an acid-dyeable nylon is knitted to form a fabric. The resulting fabric has pale green, peach, pink, blue and white areas. This fabric is then conventionally dyed using acid dyes which color only the nylon ends. In this manner, unique and pleasing fabrics may be obtained.

Clearly, the substantial advantages of dyeing yarn in accordance with the present invention are the simplicity of the process, minimization and full utilization of the dyestuffs, the absence of effluent which must be discharged, and low energy requirements.

In the embodiments of the present invention described above, the preferred means for attaining selective distribution of a yarn treating agent into a yarn package is a foraminous plate which contacts one or both ends of the package. It is to be understood that a foraminous member other than a plate, e.g. a member of cylindrical shape having foramina around the periphery thereof, may also be utilized. In such instance, the yarn treating agent is introduced through the circumferential surface of the yarn package, or selected portions thereof.

Although the illustrative examples set forth above involve the treatment of specific fibers, it should be understood that the methods of the present invention may be used to treat any type of fiber with the desired type of treating agent. Among the fibers which may be treated or dyed by the present process are nylon fibers, acrylic fibers, wool fibers and polyester fibers, and mixtures thereof. The following forms of light and heavy denier fibers are exemplary of those which may be treated according to the present process: carpet fiber; apparel fiber; fibers used in woven, tufted, knitted, flocked and non-woven fabrics; and non-texturized feeder denier fiber.

The present invention may also be used to perform the following treatments in addition to the application of resists, dyes, and lubricants: application of fire-retardants and water-repellants to yarn or fiber; application of materials to improve the dyeability of yarn or fiber; treatment to weaken or strengthen yarn or fiber; and heat setting yarn or fiber; and the like.

In an optional embodiment of the present invention, a premeasured and prepackaged quantity of yarn treating material, such as a resist, is placed on the top or bottom of the yarn package before the package is placed within the present apparatus. In this embodiment of the invention the apparatus associated with the addition of the treatment material (35 and 36) would not be necessary. After the package is placed between the headers 12 and 19 and header 19 is brought down into engagement with the top of the package, the heated fluid is pumped into the package as disclosed previously. In this embodiment as in the others described above, the package is totally resisted throughout a determinable portion thereof with a second area of partial resist at the end of the totally resisted area, and a third area having no resist.

The container for the premeasured prepackaged quantity of treatment chemical is constructed from a material which is porous to the transmission of the heated fluid or is soluble in the heated fluid so that upon contact with the heated fluid, the container dissolves and permits infusion of the treatment material into the yarn package. In a preferred embodiment of the present invention a filter medium such as a paper or fabric filter is placed between the quantity of treatment chemical and the yarn package. The filter medium entraps any undesirable residue in the treatment material for easy removal and disposal.

It should be understood that with all embodiments of the present invention, the entire process may be automated for efficient and economical operation. Such automation would include the obvious methods of sequential processing of the yarn package according to the present invention with only a minimum amount of supervision and control.

In an interesting embodiment of the present invention, one or more of a resist chemical and phosphate is encapsulated in a material which is soluble within the heated fluid so that upon contact with the heated fluid the capsule dissolves and mixing of the resist and phosphate occur. By encapsulating one or more of these materials, and particularly the resist chemical, it is possible to maintain the concentration of water within the mixture at a minimum. It is desirable to reduce the amount of water added to a yarn package to a minimum so that a dry package may be ultimately obtained. It is recognized that other materials may also be used to effectively adjust the pH of this resist chemical as disclosed and obtain a resist material useful in the present process.

Other changes will suggest themselves to those skilled in the art; thus, the particular methods and apparatus here presented are by way of illustration only, and do not restrict the scope of the invention as defined by the appended claims.

What is claimed is:

1. The process of treating a mass of yarn in package form comprising the steps of infusing a yarn treating agent into selected portions of the outer surface of said package, and introducing a heated fluid under pressure into said selected portions.

2. The method of claim 1 in which the treating agent comprises a dye.

3. The method of claim 1 in which the treating agent comprises a mixture of a yarn lubricant and a resist.

4. The method of treating a mass of yarn in package form to create repeating sequences of contiguous lengths of yarn having differing dye susceptibility comprising the steps of infusing a dye acceptance modifier into selected portions of the outer surface of said package, and subjecting said selected portions of said package to a heated fluid under pressure to cause said modifier to at least partially penetrate said package.

5. The method of treating a mass of yarn in package form to create repeating sequences of fully resisted, partially resisted, and untreated lengths of yarn comprising the steps of infusing a predetermined amount of resist into at least one end of said package, passing steam at an elevated temperature and pressure into said end of said package to cause said resist to partially penetrate said package, and maintaining said package at an elevated temperature to set the resist in the package.

6. The method of claim 5 in which the resist and steam are passed through both ends of the package.

7. The method of claim 5 including the subsequent step of dyeing the treated yarn with at least one dye stuff which will dye the untreated and partially resisted lengths of yarn but will not dye the fully resisted lengths.

8. The method of claim 5 including the subsequent steps of constructing a fabric utilizing untreated yarns and the said treated yarn, and dyeing the said fabric.

9. The method of claim 7 in which a second dyestuff is used which will preferentially dye the fully resisted and partially resisted lengths of yarn.

10. The process of treating a mass of yarn in package form comprising the steps of urging a foraminous member against a selected portion of the outer surface of said package, passing a yarn treating agent under pressure through the foramina of said foraminous member, and subsequently passing a heated fluid through said foramina.

11. The process of claim 10 in which said yarn treating agent comprises a dyestuff.

12. The process of treating a package of yarn comprising the steps of urging a foraminous plate against one end of said package of yarn, passing a yarn treating agent under pressure through the foramina and said foraminous plate, and subsequently passing a heated fluid through said foramina.

13. The process according to claim 12 wherein said yarn treating agent is a resist chemical that is set by heat, and the step of passing a heated fluid through said foramina is continued for a duration of from about 30 seconds to about 5 minutes.

14. The process according to claim 12 wherein a second foraminous plate is against the opposite end of said package of yarn, said yarn treating agent is passed through the foramina of both said foraminous plate and said second foraminous plate, and said heated fluid is passed through the foramina of both said foraminous plate and said second foraminous plate.

15. A method of differentially treating yarn in package form comprising the steps of infusing a yarn treating agent into at least one end of said package, and passing a heated fluid under pressure into said end of said package to transport said treating agent at least partially through said package.

16. The method of lubricating a mass of yarn in package form comprising the steps of infusing a yarn lubricant into at least one end of said package, and introducing steam into said one end of said package, whereby the lubricant penetrates and diffuses into said package.

17. A method of dyeing yarn in package form comprising the steps of urging a foraminous plate against one end of said package, passing at least one dyestuff through at least a portion of the foramina of said foraminous plate, and subsequently passing a heated fluid through said foramina.

18. A method for treating a package of yarn to create repeating sequences of differently colored lengths of yarn comprising the steps of urging a foraminous plate against at least one end of said package, passing a first dyestuff through a first portion of the foramina of said foraminous plate, passing a second dyestuff through a second portion of the foramina of said foraminous plate, and passing a heated fluid through both the said first and second portions of the foramina of said foraminous plate.

19. A method for dyeing yarn in package form with a plurality of different colors comprising the steps of urging a first foraminous plate against one end of said package and a second foraminous plate against the other end of said package, infusing at least a first dyestuff through a portion of the foramina of said first foraminous plate and into said one end of said package, infusing at least a second dyestuff through a portion of the foramina of said second foraminous plate and into said other end of said package, and passing a heated fluid through said foramina.

* * * * *